US005779616A

United States Patent [19]

Hintermeier et al.

[11] Patent Number: 5,779,616

[45] Date of Patent: Jul. 14, 1998

[54] FORMER FOR A PRINTING MACHINE

[75] Inventors: Otto Hintermeier, Augsburg; Reinhold Litzel, Königsbrunn; Hans Schwöpfinger, Augsburg, all of Germany

[73] Assignee: Man Roland Druckmaschinen AG, Offenbach AM Main, Germany

[21] Appl. No.: 538,966

[22] Filed: Oct. 5, 1995

[30] Foreign Application Priority Data

Oct. 5, 1994 [DE] Germany ..... 44 35 528.9

[51] Int. Cl.[6] ..... B65H 45/22

[52] U.S. Cl. ..... 493/439; 493/446; 493/456

[58] Field of Search ..... 493/31, 32, 34, 493/256, 313, 405, 410, 416, 417, 436, 438, 439, 446, 447, 448, 450, 455, 456

[56] References Cited

U.S. PATENT DOCUMENTS

| | | | |
|---|---|---|---|
| 229,479 | 6/1880 | Scholfield . | |
| 3,111,310 | 11/1963 | Dutro . | |
| 4,321,051 | 3/1982 | Hajek | 493/439 |
| 4,421,501 | 12/1983 | Scheffer | 493/439 |

FOREIGN PATENT DOCUMENTS

| | | |
|---|---|---|
| 1142878 | 1/1963 | Germany . |
| 2163408 | 7/1973 | Germany . |
| 2240397 | 2/1974 | Germany . |
| 862296 | 3/1961 | United Kingdom . |

*Primary Examiner*—Joseph J. Hail, III
*Assistant Examiner*—Christopher W. Day
*Attorney, Agent, or Firm*—Cohen, Pontani, Lieberman, Pavane

[57] ABSTRACT

A former for folding a stock web including a nose plate (1) having a base plate (4) covered by a cover plate (5). Openings (8) are provided extending to the surface of the cover plate on which the stock web runs. The openings (8) are preferably formed by recesses in the side edges of the cover plate (5) positioned where the cover plate (5) contacts the base plate (4).

10 Claims, 4 Drawing Sheets

FORMER FOR A PRINTING MACHINE

BACKGROUND OF THE INVENTION

1. Field of the Invention

The present invention relates to a former for folding a stock web and, more particularly, to a former including openings for supplying compressed air which can be easily cleaned.

2. Description of the Related Art

Formers are well-known in the art. For example, German reference document No. DE AS 2 240 397 discloses a former for longitudinally folding paper webs processed in rotary printing machines having a funnel shaped nose plate and nose. The funnel shaped nose plate consists of two plates lying one above the other. Air supply ducts are worked into both plates, from which fine borings lead through the upper plate to the outer surface of rounded-off longitudinal edges of the former. Under the influence of compressed air the web is lifted up slightly from the former so that friction is reduced.

German reference document No. DE-AS 1 142 878 and Great Britain reference document No. GB 862 296 disclose formers including borings for supplying compressed air to a lower side of the stock web to reduce friction between the web and the former. German reference document No. DE-AS 2 163 408 discloses a former having a recess extending across most of its breadth and through which a solution, for example, an air-liquid mixture, can be sprayed onto the stock web.

SUMMARY OF THE INVENTION

It is an object of the present invention to provide a former including openings for supplying compressed air which are easily cleaned.

In accordance with the present invention, the openings for supplying compressed air are located in a surface formed by a cover plate and those areas of a base plate bordering the cover plate, not in the area of the lateral edges of the nose plate bending over the stock web as disclosed in the prior art. Due to this construction, it is possible to achieve a more even supply of compressed air below the web. It has been shown that when air is to be supplied to the area of the edges, such as in German reference document No. DE-AS 2 240 397 mentioned previously, the supply of air to this area is possible only under high air pressure as the high pressure acts to press the web against the former.

It is especially advantageous to form the openings for the air supply as lateral recesses on the borders of the cover plate lying atop the base plate. Thus, when a different printing material requires a different quantity of air, it is possible to change the size of the openings, and thus the quantity of air by changing the position of the cover plate.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

BRIEF DESCRIPTION OF THE DRAWINGS

In the drawings wherein like numerals are used to denote similar elements throughout the several views.

DETAILED DESCRIPTION OF THE PREFERRED EMBODIMENT

Figure 1:
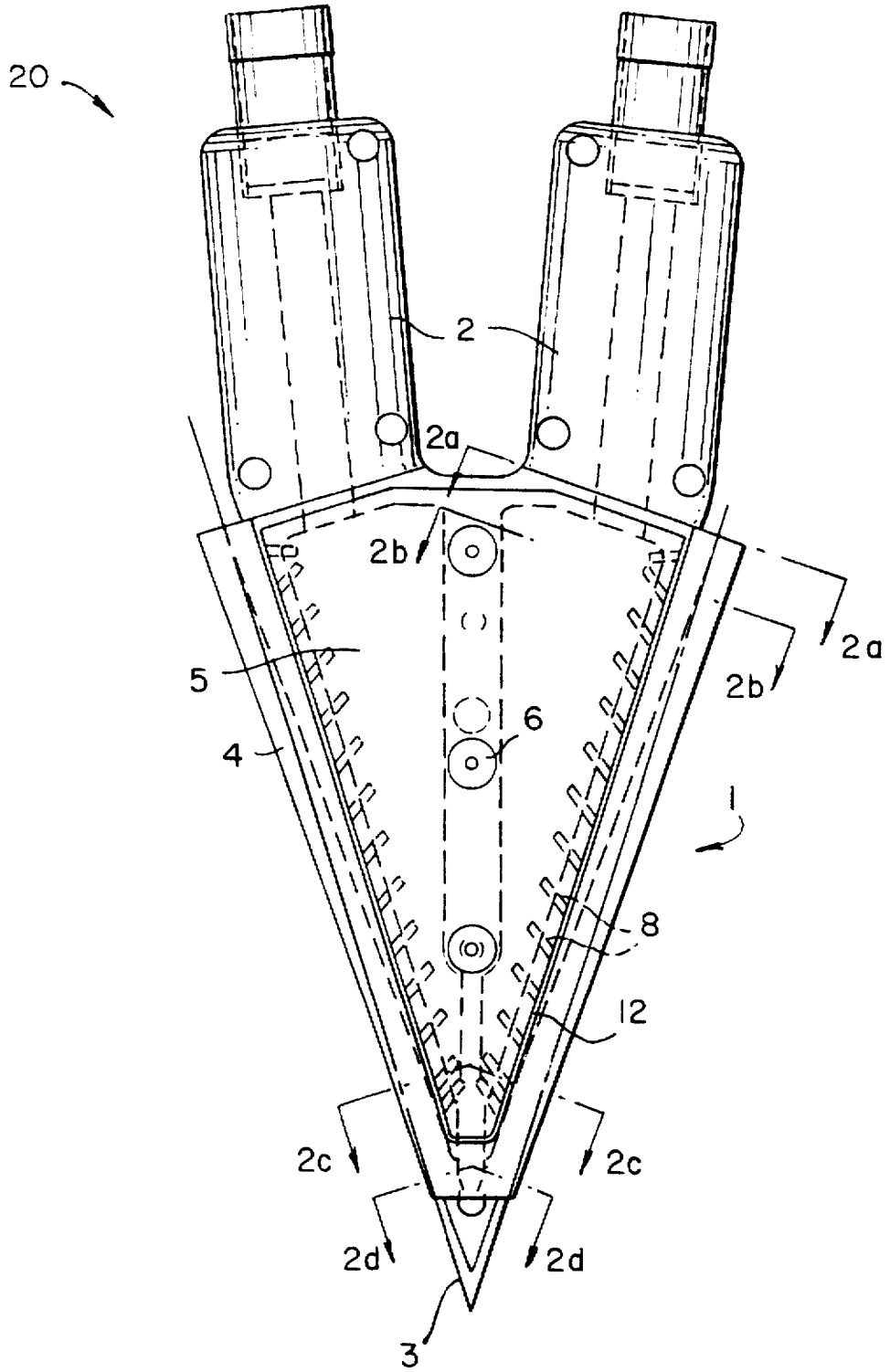
FIG. 1 is a top view of a nose plate of a former constructed in accordance with the present invention.

FIG. 1 illustrates a former in accordance with the present invention and labelled generally by the numeral 20. The former 20 includes a nose plate 1 in a front end thereof connected on its upper sides, i.e. where the former broadens, to a former plate (not shown) via holding plates 2.

A former nose 3 is attached to the nose plate 1 at a tip end of the former. The nose plate 1 includes a base plate 4 having outer side edges 13 and a cover plate 5 having a bottom face 18 resting on an upper face 17 of the base plate 4. The cover plate 5 is connected to the base plate 4, for example, by screws 6 as shown in FIG. 1 although any suitable device for connecting the cover plate 5 to the base plate 4 may be used. Between the base plate 4 and cover plate 5 are cavities 7 which permit the supply of compressed air to openings or air ducts 8 as can be seen from FIGS. 2*b*, 2*c*, 3*a* and 3*b*. Compressed air flows from the cavities 7 onto a surface 9 constituting the folding area of the cover plate 5 through the openings 8. The folding area is set back relative to a surface 90 formed by the base plate 4 permitting the air cushion to spread from the openings 8 across the entire surface 9 below the web, thus minimizing the effects of friction on the web. It is preferred that a thickness of the cover plate 5 is at most equal to a height of the rounded off side edges 13 providing at most a flush surface with the surface 90.

Figure 2A:
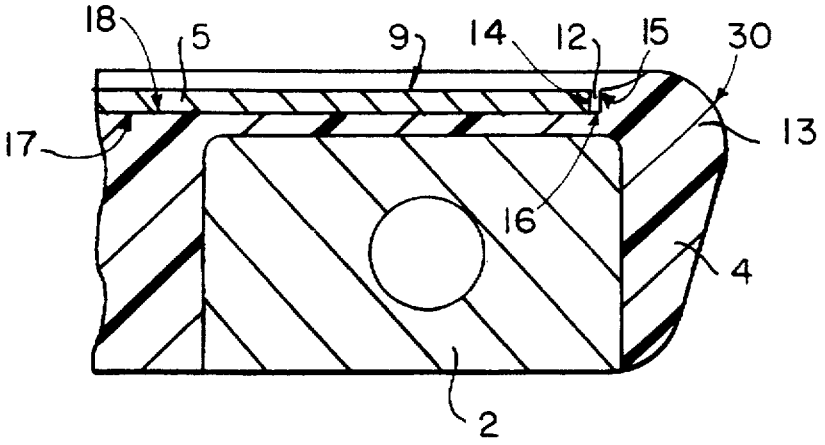
FIGS. 2*a*, 2*b*, 2*c* and 2*d* are enlarged side views of the nose plate taken along the lines A, B, C, and D, respectively, of FIG. 1.
Figure 2B:
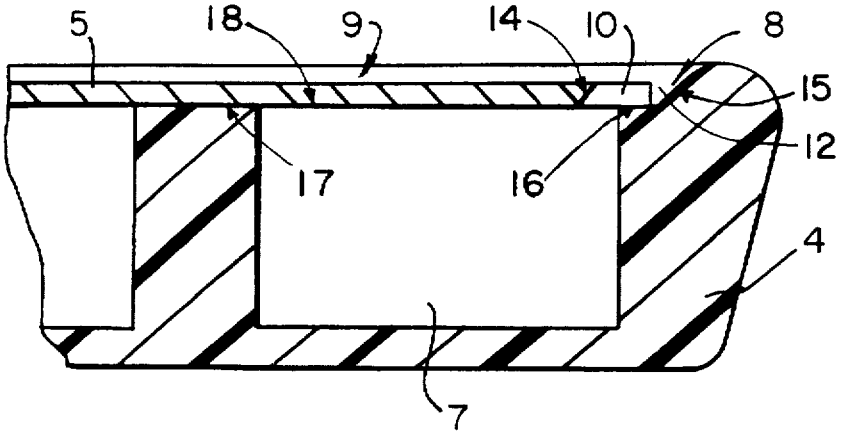
Figure 2C:
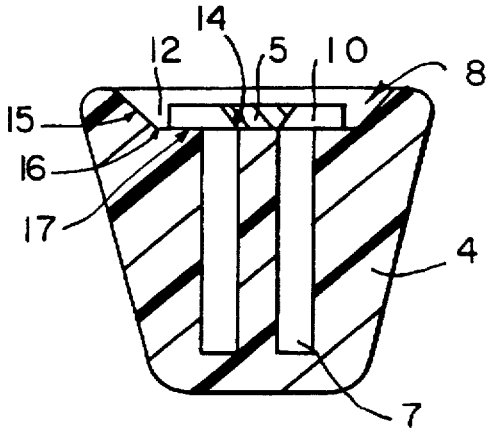
Figure 2D:
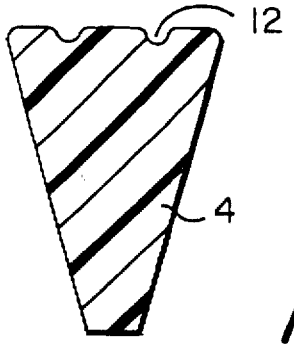
Figure 3A:
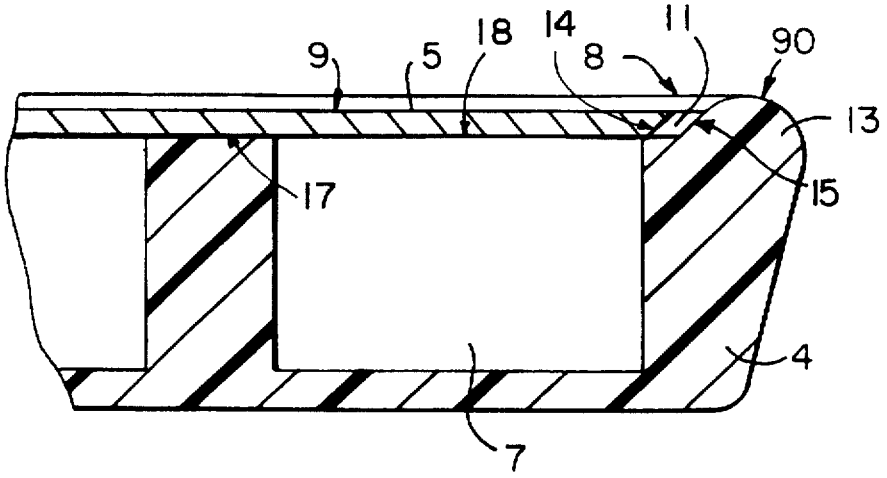
FIGS. 3*a* and 3*b* are enlarged side views taken along lines B and C, respectively, of an alternate embodiment of the cover and base plate shown in FIGS. 2*a*–2*d*.
Figure 3B:
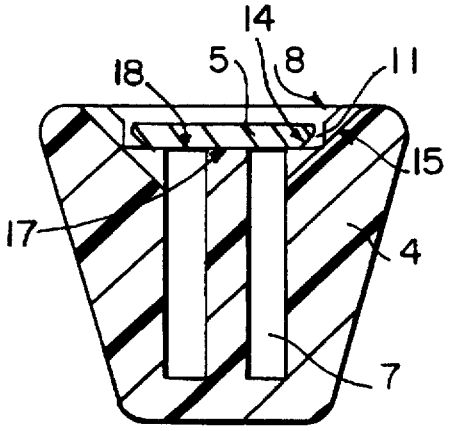

The openings 8 are formed either by recesses 10 in the side wall 14 of the cover plate 5 resting on the base plate 4 as depicted in FIGS. 2*b* and 2*c* or by recesses 11 in the sidewall 15 of of the base plate 4 positioned near the sidewall 14 of the cover plate 5 resting on the base plate 4 as depicted in FIGS. 3*a* and 3*b*. Alternatively, the openings 8 may also be partly in cover plate 5 and partly in base plate 4. Between the openings 8 are groove-type depressions or channels 12 running between the surfaces 9 and 90 and formed by the edges of the base plate 4 and the cover plate 5 as is depicted in FIGS. 2*a*, 2*b*, 2*c*, 3*a* and 3*b* or only in the base plate 4 as depicted in FIG. 2*d*. The depressions 12 aid in the spreading of the compressed air onto the surface 9. The bottom of the channels is indicated with 16.

Especially advantageous is the first variant depicted in FIGS. 2*b* and 2*c* in which the openings 8 are located in the cover plate 5 positioned at the peripheral side wall 14 of the cover plate 5 resting on the base plate 4. In this embodiment, the cover plate 5 may be replaced by a different cover plate having, for example, particular shapes, sizes, quantity and distribution matched to special requirements of a particular stock web to permit a stronger air cushion to be built up between the web and the former when a different printing stock, for example, one having a higher share of filler, is used.

The removable cover plate 5 not only permits the former to be adjusted to different web speeds and paper types, but also to be easily cleaned. This is necessary because the air outlet openings 8 easily become clogged by paper fibers.

Figure 4A:
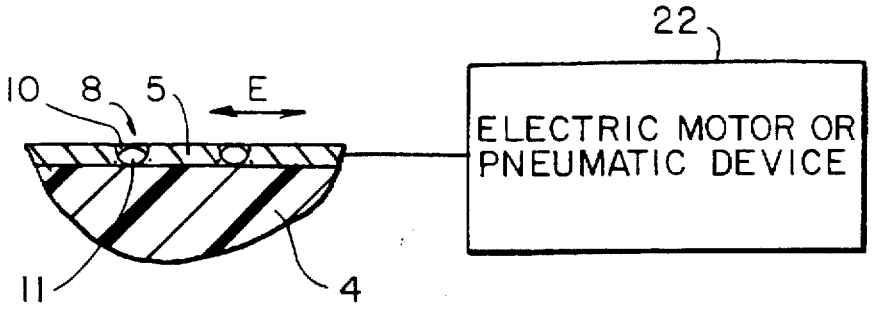
FIGS. 4*a* and 4*b* are enlarged side views of the nose plate taken in an area in which the cover plate rests on the base plate.
Figure 4B:
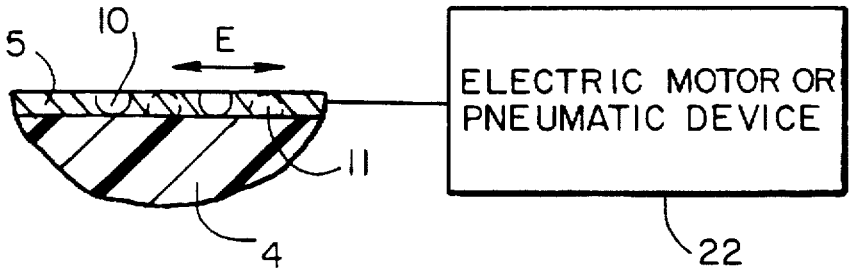

In another embodiment depicted in FIGS. 4*a* and 4*b* both the base plate 4 and the cover plate 5 have recesses 11 and 10 positioned about the peripheral sidewall 14 of the cover plate 5 resting on the base plate 4. When the recesses 10 and 11 lie one atop the other as depicted in FIG. 4*a*, the openings 8 formed by the aligned recesses 10, 11 are open to the greatest extent. By moving the cover plate 5 in one of the two directions indicated by the double arrow E, it is possible to vary the size of the openings 8 by offsetting the recesses 10, 11 from a maximum point at which the recesses 10, 11 are in alignment to no opening as depicted in FIG. 4*b* the recesses 10, 11 are completely offset. It is also advantageous to connect a device 22 such as an electric motor or pneumatic device for moving the cover plate 5 automatically. Thus, the size of the openings can be automatically controlled.

Under certain circumstances, it is useful to subject the openings 8, at least in certain areas, to a vacuum instead of compressed air. For example, when the openings 8 in the part of the nose plate 1 facing the nose 3 of the former 20 and openings in the nose 3 of the former 20 are connected to a vacuum, it is possible to support the folding of the stock web at the tip of the former 20, because the stock web can be more effectively pressed against the former 20, while the slide friction between the stock web and the nose plate 1 is reduced in the rear part of the former 20, for example, by compressed air being blown out of the openings located in this part of the nose plate 1. The separation between the compressed air supply and the applied vacuum may be implemented via the individual cavities 7 between the base plate 4 and the cover plate 5, when each of the cavities 7 includes a separate feed-in.

Furthermore, it is possible to adjust the angle at which the air emerges onto the surface 9 of the nose plate 1 according to web speed and type of paper; this is preferably done by exchanging the cover plate 5 for a different cover plate 5, in which the recesses 10 are slanted differently.

A nose plate 1 for a former constructed in accordance with the present invention includes a base plate 4 covered by a cover plate 5. There are openings 8 to the surface 9 of the cover plates on which the web runs. The openings 8 are preferably formed by recesses 10 in the side edges of the cover plate 5 positioned where the cover plate 5 rests on the base plate 4.

The invention is not limited by the embodiments described above which are presented as examples only but can be modified in various ways within the scope of protection defined by the appended patent claims.

We claim:

1. A former for longitudinally folding a web, comprising:

a nose plate including a base plate having a recessed upper face and a bordering edge region that borders the recessed upper face and has a top surface from which the upper face is recessed and an internally directed sidewall, the nose plate further including a cover plate having an upper face, a lower face and a peripheral sidewall, the cover plate being arranged so that the lower face rests on the recessed upper face of the base plate and so that the peripheral sidewall is opposite the sidewall of the base plate, whereby a running surface for the web is formed by the upper face of the cover plate and the top surface of the bordering region of the base plate, the base plate and the cover plate being configured to define a plurality of air ducts disposed between said base plate sidewall and said cover plate sidewall to provide a passage between said running surface and the web.

2. The former of claim 1, wherein said upper face of said base plate is recessed to a depth and said cover plate has a thickness at most equal to the depth of said recessed upper face.

3. The former of claim 1, wherein said nose plate further includes a tip portion, said plurality of air ducts being positioned proximate said tip portion.

4. The former of claim 1, wherein said plurality of air ducts are defined by recesses in one of said peripheral cover plate sidewall and said base plate sidewall.

5. The former of claim 1, wherein said plurality of air ducts are defined by recesses in both said peripheral cover plate sidewall and said base plate sidewall, said recesses in said peripheral cover plate sidewall communicating with said recesses in said base plate sidewall.

6. The former of claim 1, further comprising at least one cavity positioned between said base plate and said cover plate to provide a fluid-flow passage to said plurality of air ducts.

7. The former of claim 1, wherein a plurality of depressions are formed between said base plate sidewall and said peripheral cover plate sidewall for connecting together said plurality of air ducts.

8. The former of claim 7, wherein said plurality of depressions form a channel between said base plate sidewall and said peripheral cover plate sidewall.

9. The former of claim 1, wherein at least one of said plurality of air ducts is configured to provide a passage for removing air from between said running surface and said web.

10. The former of claim 1, wherein said plurality of air ducts extend at an angle to said upper surface of the cover plate.

* * * * *